US005206504A

United States Patent [19]

Sridharan

[11] Patent Number: 5,206,504

[45] Date of Patent: Apr. 27, 1993

[54] SAMPLE POSITIONING IN MICROGRAVITY

[75] Inventor: Govind Sridharan, Bangalore, India

[73] Assignee: The United States of America as represented by the Administrator, National Aeronautics and Space Administration, Washington, D.C.

[21] Appl. No.: 786,612

[22] Filed: Nov. 1, 1991

[51] Int. Cl.[5] ..... H05H 3/04

[52] U.S. Cl. ..... 250/251

[58] Field of Search ..... 250/251; 356/335

[56] References Cited

U.S. PATENT DOCUMENTS

| | | | |
|---|---|---|---|
| 3,710,299 | 1/1973 | Ashkin | 250/251 |
| 3,808,550 | 4/1974 | Ashkin et al. | 250/251 |
| 4,023,158 | 5/1977 | Corcoran | 250/251 |
| 4,092,535 | 5/1978 | Ashkin et al. | 250/251 |

OTHER PUBLICATIONS

E. C. Okress et al., J. Applied Phys. 23, 545 (1952).
G. Sridharan, Rev. Sci. Instrum. 54, 1418.
G. Sridharan, et al., Proc. SPIE Space Opt. Mat. Space Qualification Opt. 1118, 160 (1989).
T. G. Wang, et al., AIAA Paper #74-155 (1974).
S. J. Padack, and J. W. Rhee, Geophys. Res. Lett., 2, 365 (1975).
A. Aindow et al., in Laser Advances and Applications, Proc. 4th Quantum Electronics Conf., (Wiley, NY, 1980).
R. E. Wagner, J. Appln. Phys., 45, 4631 (1974).
A. Ashkin, Science, 210, (1980).

*Primary Examiner*—Bruce C. Anderson
*Attorney, Agent, or Firm*—John H. Kusmiss; Thomas H. Jones; Guy M. Miller

[57] ABSTRACT

Repulsion forces arising from laser beams are provided to produce mild positioning forces on a sample in microgravity vacuum environments. The system of the preferred embodiment positions samples using a plurality of pulsed lasers providing opposing repulsion forces. The lasers are positioned around the periphery of a confinement area and expanded to create a confinement zone. The grouped laser configuration, in coordination with position sensing devices, creates a feedback servo whereby stable position control of a sample within microgravity environment can be achieved.

19 Claims, 2 Drawing Sheets

SAMPLE POSITIONING IN MICROGRAVITY

ORIGIN OF THE INVENTION

The invention described herein was made in the performance of work under a NASA contract, and is subject to the provisions of Public Law 96-517 (35 U.S.C. Section 202) in which the Contractor has elected not to retain title.

TECHNICAL FIELD

The present invention relates to sample positioning in microgravity environments and, more particularly, to a laser positioning system for sample positioning in microgravity environments.

BACKGROUND OF THE INVENTION

Materials processing in space uses the novel behavior of materials in near zero gravity or microgravity. Unusual microstructures result in such processes due to the absence of container contamination and the reduction of nucleating heterogeneities. Furthermore, the elimination of gravity induced convection may minimize structural defects in the processing of semiconductor materials.

However, zero gravity is not easy to achieve, even in space shuttle flights. Spacecraft trajectory alterations (providing a force approximately $10^{-7}$ g), accelerations associated with atmospheric drag (providing a force approximately $10^{-6}$ g), and astronauts' movements (providing a force approximately $10^{-3}$ g) will lead to relative motion between the levitated specimen and the spacecraft reference frame. Hence, there is a need for an adequate sample positioning control system.

In conventional systems for the containerless processing of materials, the known sample positioning methods (also called sample levitation) use a variety of techniques for generating the requisite force to confine the sample within a predefined zone. The past sample positioning systems for manipulating the position of a sample include: electromagnetic suspension, electrostatic levitation, and acoustic levitation.

The type of force generating mechanism used to levitate a sample depends on the sample's characteristics; i.e., whether it is a metal, nonmetal, or liquid drop. However, the conventional methods cannot be used for the containerless processing of a nonmetallic sample material at elevated temperatures, under vacuum microgravity conditions.

The following table compares the attributes of these various techniques:

| | Comparison of the various methods for sample positioning | | | |
|---|---|---|---|---|
| | Active Magnetic Levitation | Electromagnetic (Eddy-current) Levitation | Acoustic Levitation | Electrostatic Levitation |
| Sample material | Ferromagnetic | Electrically conductive materials | Metallic, nonmetallic, liquid drops | Metallic nonmetallic, liquid drops |
| Control requirement | Feedback servo | No servo needed | No servo needed | Feedback servo |
| Power | Small | Large | Medium | Small |

-continued

| | Comparison of the various methods for sample positioning | | | |
|---|---|---|---|---|
| | Active Magnetic Levitation | Electromagnetic (Eddy-current) Levitation | Acoustic Levitation | Electrostatic Levitation |
| required to levitate one gram | (several mW) | (--kW) | (about 100 W) | (several mW) |
| Sample heating | External means | High degree of self-heating | External means | External means |
| Levitation under vacuum | Possible | Possible* | Not possible | Possible |
| Levitation of sample at high temperature | Not possible | Possible | Possible | Not possible |

From the table it might be through that acoustic and electrostatic levitation methods would be suitable for the containerless processing of nonmetallic specimens. However, the acoustic technique cannot work under vacuum; and electrostatic levitation would become unstable at temperatures in excess of 600° C. and at vacuum levels greater than $10^{-5}$ Torr. This control instability of electrostatic levitation is due to field-induced emission, anomalous charging mechanisms, and thermionic emission, which prevent levitation at high temperatures.

Furthermore, in these conventional methods listed, the work envelope is directly coupled with the parameters of the force generating mechanism. In the electrostatic levitation method, a limitation on high voltage restricts the interelectrode distance and the amount of sample traverse available. In electromagnetic suspension the coil geometry and the high frequency current also limit the work space.

FIG. 1 shows a Venn diagram that depicts the various combinations of environmental conditions possible where sample levitation might be used. In FIG. 1, the ambient atmosphere is shown by reference numeral 1 and vacuum as reference numeral 2. A high temperature condition is shown as reference numeral 3, the use of a nonmagnetic sample as reference numeral 4, and the use of a nonmetallic sample as reference numeral 5.

By comparing the information within the table above and the Venn diagram of FIG. 1, we can depict the need for a new sample positioning method that is especially suited for high temperature, high vacuum processing of samples in microgravity. This environmental region shown by the pie (reference numeral 6) within the Venn diagram of FIG. 1 is, viz., the levitation of a nonmetallic, nonconductive specimen, at elevated temperatures, under vacuum. The instant invention recognizes that a laser levitation system would be acceptable for levitating a sample within these environmental conditions.

Laser systems have been provided to levitate and position particles within a gravity-oriented vacuum environment. U.S. Pat. No. 4,092,535 to Ashkin et al. discloses a levitation device in which a single laser beam is directed into a vacuum chamber in which a particle is to be levitated.

Recognizing the instabilities inherent within a vacuum oriented laser levitation system, U.S. Pat. No. 4,092,535 includes a feedback system. The feedback system detects the scattered light from the laser beam, which is scattered by the suspended particle, to provide feedback signals. The feedback signals include an error rate feedback signal to control vertical particle deflections and a beam adjustment feedback signal. These signals are of great importance in gravity environments. U.S. Pat. Nos. 3,710,279 and 3,808,550 to Askin et al. use plural laser beams directed at a particle.

In each of these designs, the particle is lifted by directing the laser beam incident specifically focussed upon the particle. Although these designs place the maximum force and momentum of the laser beam upon the particle, it produces large, recognized instabilities.

These levitation designs are akin to placing a ball upon the head of a pin and pushing. The ball is bound to be deflected and fall over. In response to these instabilities, U.S. Pat. No. 4,092,535 provides a computer feedback system. Furthermore, these conventional laser designs cannot provide for the levitation of an entire sample. They can only be used for isolated particles.

OBJECTS OF THE INVENTION

Therefore, it is an object of the present invention to provide a position control system which can be used in the containerless processing of materials, especially nonmetallic specimens, in a microgravity environment.

It is a further object of the invention to provide a position control system usable in a microgravity environment with a high temperature, and is suitable for processing nonmetallic, nonconductive specimens.

It is yet a further object of the present invention to provide a position control system usable in a microgravity, vacuum environment which is stable and suitable for processing an entire sample.

It is yet a still further object of the present invention to provide a microgravity position control system capable of stably positioning a sample within a large work space, and is able to allow the sample to be heated without disrupting the stability of the positioning system.

SUMMARY OF THE INVENTION

These and other objects are achieved by the present invention, which provides opposing laser repulsion forces to confine a sample within a predefined processing confinement zone. In the preferred embodiment, a laser system having a multiple laser configuration provides repulsion forces and thereby positions micronsized aerosol particles within a defined confinement zone.

Instead of trying to lift or levitate the sample particles, the invention uses laser repulsion forces to merely confine the sample. Although the invention is not limited to nonmetallic particles, the invention is particularly suited for positioning nonmetallic particles at high temperatures, which type of positioning was previously unattainable.

In the preferred embodiment, a feedback control scheme is used to overcome the instabilities of the laser repulsive forces, and to maintain specific control over the sample position within the confinement zone. Stable control of the sample position within a three-dimensional space is provided by combining and offsetting the repulsion effects of multiple laser beams.

The preferred embodiment provides a confinement system using a "position control servo" that includes positioning lasers around the confinement area for providing opposing repulsion forces. Such a position control servo allows the use of a feedback system whereby position sensitive devices provide position signals to control and modify the confining beams' parameters.

BRIEF DESCRIPTION OF THE DRAWINGS

The present invention, both as to its organization and manner of operation, together with further objects and advantages, may be understood by reference to the following drawings.

DETAILED DESCRIPTION OF THE INVENTION

The following description is provided to enable any person skilled in the art to make and use the invention and sets forth the best mode contemplated by the inventor of carrying out his invention. Various modifications, however, will remain readily apparent to those skilled in the art, since the generic principles of the present invention have been defined herein.

The present invention uses a grouped laser system to generate mild repulsion forces for the processing of samples in a microgravity environment. A microgravity environment is inherently distinct from a ground-based environment, since the gravitational and other external forces are minimized in microgravity. A sample position control system needs to provide much smaller corrective forces in microgravity, as compared to similarly situated ground-based systems.

As discussed above, conventional designs in this field have used the direct and focussed power of a laser beam to specifically effect the positioning of micronsized aerosol particles. The present invention is distinctly different. The present invention uses the repulsion forces of laser beams for directing and confining a sample. Furthermore, the present invention is able to resolve the inherent lack of stability of a repulsion type of levitation (or positioning) force by a feedback control strategy enabled by the configuration used.

The present invention recognizes that the mild interaction force between a pulsed laser beam and a floating sample are able to counter the diminutive acceleration forces present in a coasting space vehicle. The present invention is able to position a sample by harnessing the repulsion forces created by a set of pulsed laser beams placed within a grouped, interactive array.

Figure 1:
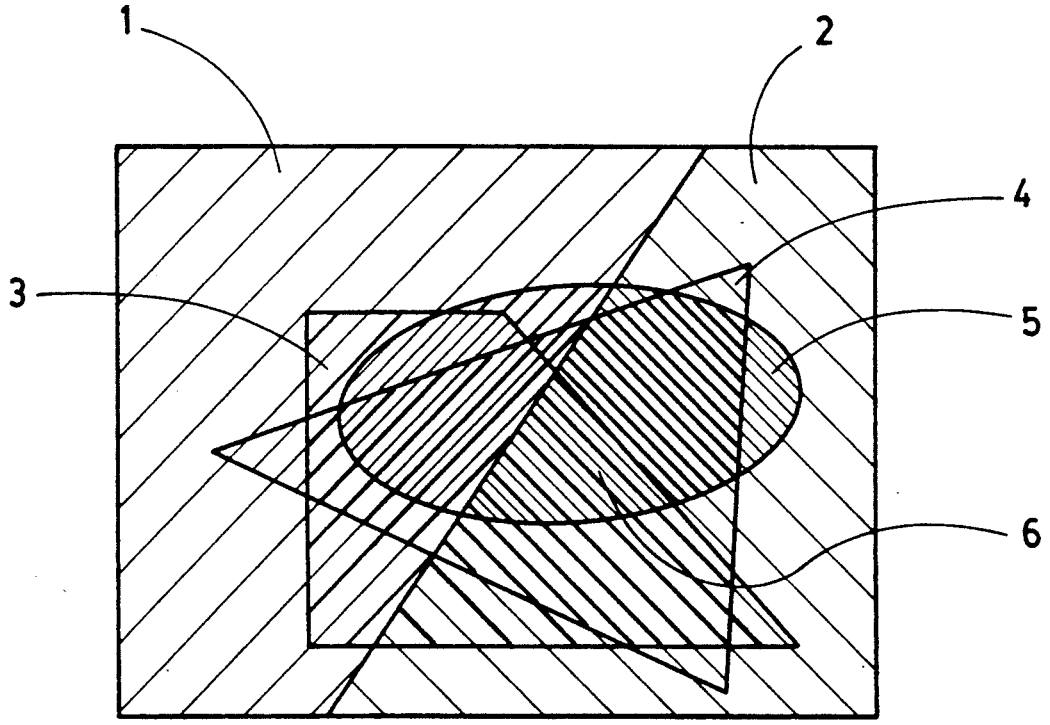
FIG. 1 is a Venn diagram showing the various combinations of environmental conditions of interest for sample positioning.
Figure 2:
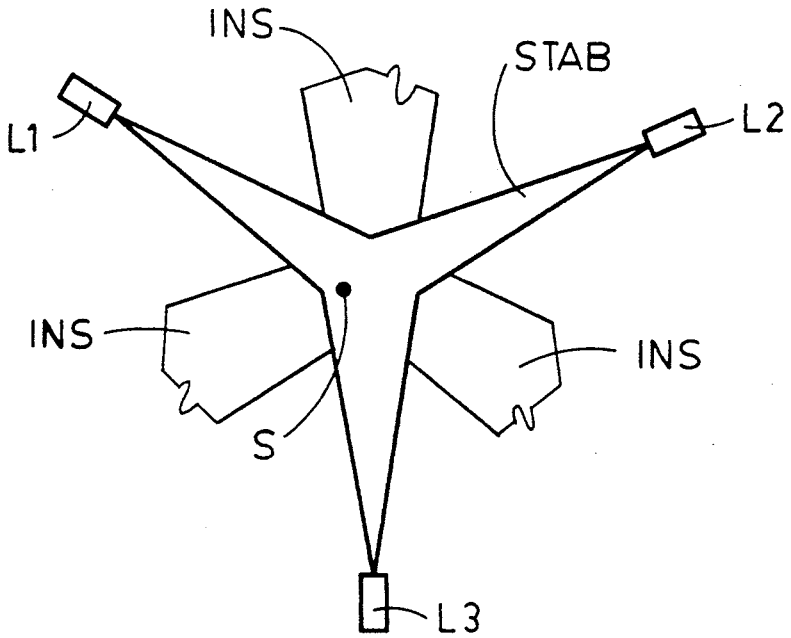
FIG. 2 is a schematic diagram of the system of the preferred embodiment of the invention.

FIG. 2 shows a schematic of the positioner used in the preferred embodiment of the present invention. To accomplish a stable control of the position of a sample S in a three-dimensional reference frame, four opposing pulsed laser beams with beam expanders L1, L2, L3, L4 are employed. The pulsed laser beams are expanded in order to provide a three-dimensional, cross-sectional repulsion area of force on the sample. The preferred embodiment positions the pulsed laser sources (or the directing lenses) at the four corners of a tetrahedron.

A region of stability STAB is created where each of the laser beam's cross-sections is able to repel the sample into some interaction with the other laser beams.

Thereafter, a region of instability INS is seen where the beams are directed past the boundaries of the beam's interaction. Ideally, to maintain stability and yet avoid intense heating and vaporization of the sample material, the beam cross-sections at the sample should be only slightly greater than, or equal to, the sample diameter.

The radiation pressure felt by an absorbent material (due to a single beam) may be determined as:

$$p=(e/T\,c_o)\,10^7\ dynes \quad (1)$$

where e is the energy density of the pulsed beam at the sample interaction (j/cm$^2$), T is the pulse duration (s), and $c_o$ is the speed of light (cm/s).

In the positioning configuration of the preferred embodiment, any desired force vector can be synthesized by activating a certain combination of the beam characteristics, such as duration and duty cycle. In this manner, a confinement zone is located, and a feedback servo can be achieved to stably maintain the sample positioning.

To give an example, by configuring identical characteristics on pulsed laser sources L1, L2, and L3, the sample may be forced by the opposing repulsion from the beams of those pulsed laser sources L1, L2, and L3 to move towards laser source L4. The resultant force will then be $$F_r=3\,p\,a\,\sin(\pi/6) \quad (2)$$

where p is given by Eq. (1), and a is the projected area of each beam on the sample.

The preferred embodiment provides a position control servo. The position of the sample is measured along three coordinate axes by two position-sensitive devices D1, D2. These position-sensitive devices D1, D2 used in the preferred embodiment, use known charge coupled device (CCD) sensors and position-sensitive detectors (PSDs), as discussed by the inventor in Sridharan et al., Proc. SPIE Space Opt. Mat. Space Qualification Opt. 1118, 160 (1981), which article is incorporated herein by reference.

In the preferred embodiment, the position signals from the position sensitive devices D1, D2 lead to the feedback inputs of a four-channel PID controller, and the controller outputs are used to modify the beam parameters affecting the sample.

The present invention recognizes that only a small fraction of a dyne is enough to achieve the stable positioning of a sample having a mass of 1 gram in microgravity, and provides sufficient force for this purpose.

Figure 3:
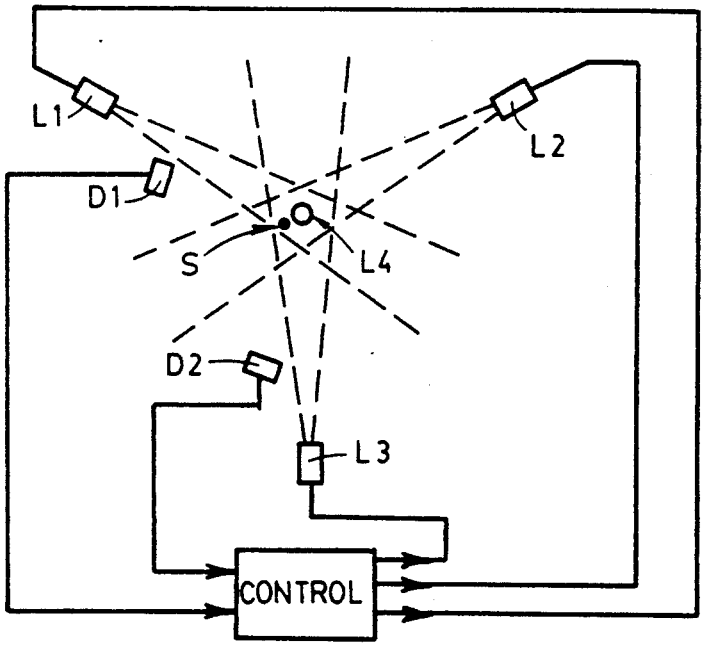
FIG. 3 is a depiction of the spatial boundaries of positioning forces shown projected on a two-dimensional plane.

In FIG. 3 the stability regions are shown for the four-beam tetrahedron laser grouping configuration of the preferred embodiment shown in FIG. 2. As can be seen, the sample S is fully controllable within the stability region STAB depicted. This, of course, is subject to a determinable maximum external perturbation force which would overcome the maximum laser repulsion forces which might be applied.

It should be noted that the sample can be positioned by the present invention within a fairly large work space. In the present invention, as a laser beam does not undergo any significant attenuation within a workspace environment, the beam expanders can be located as far away as desired. This maximizes the work space envelope.

Furthermore, the sample material can be heated up to any extent needed by radiation. The effective thrust applied to the sample by any radiation applied can be equalized. This may be done by vectorially canceling out the individual repulsion pressures which are applied by providing equal and opposite repulsion forces. Thus, combined heating and sample positioning in a microgravity experiment is made possible by the present invention.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

I claim:

1. A system for positioning samples in a low gravity environment, comprising: four lasers providing pulsed laser beams placed at four corners of a tetrahedronal three-dimensional confinement zone for generating generally opposing laser beams for providing generally opposing repulsion forces upon a sample located within said confinement zone;

a detector means for detecting the location of said sample within said confinement zone; and a feedback means for controlling and altering one or more of the intensity, duration or pulse cycle rate of the laser beams in response to detected sample movements for controlling said sample movements, said laser beams creating a confinement zone defined to include a region where the laser beams overlap and to include a region along each respective laser beam between a source of the respective laser beam and the region of beam overlap.

2. The system of claim 1 wherein the lasers include beam expanders for providing expanded beam cross-sections where the beams interact with the sample.

3. The system of claim 2, wherein the cross-sections of the laser beams approximate a maximum diameter of the sample.

4. The system of claim 1 wherein the lasers include directing lenses for directing the laser beams and for providing expanded beam cross-sections where the beams interact with the sample.

5. The system of claim 4, wherein the beam cross-sections approximate a maximum diameter of the sample.

6. The system of claim 1 wherein said detector means comprises two position sensitive devices for measuring the sample position along three coordinate axes.

7. The system of claim 6, wherein the position sensitive devices provide output signals to a four channel PID controller, the controller having means for controlling in response to the output signals.

8. The system of claim 7, wherein additional heating radiation incident upon the sample is monitored, the feedback means providing sufficient modification to the lasers to provide a repulsive force vectorially canceling an effective thrust of the heating radiation.

9. The system of claim 1 wherein the gravity environment has a gravity field with a strength less than $10^{-3}$ g.

10. A system for positioning samples in a low gravity environment having a gravity field with a strength less than $10^{3\cdot3}$ g, comprising: four lasers placed at four corners of a tetrahedronal three-dimensional confinement zone for generating generally opposing laser beams for providing generally opposing repulsion forces upon a sample located within said confinement zone;

a detector means for detecting the location of said sample within said confinement zone; and a feedback means for controlling and altering one or more of the intensity, duration or pulse cycle rate of the laser beams in response to detected sample movements for controlling said sample movements, said laser beams creating a confinement zone defined to include a region where the laser beams overlap and to include a region along each respective laser beam between a source of the respective laser beam and the region of beam overlap.

11. The system of claim 10 wherein the lasers include beam expanders for providing expanded beam cross-sections where the beams interact with the sample.

12. The system of claim 11, wherein the cross-sections of the laser beams approximate a maximum diameter of the sample.

13. The system of claim 10 wherein the lasers include directing lenses for directing the laser beams and for providing expanded beam cross-sections where the beams interact with the sample.

14. The system of claim 13, wherein the beam cross-sections approximate a maximum diameter of the sample.

15. The system of claim 10, wherein said detector means comprises two position sensitive devices for measuring the sample position along three coordinate axes.

16. The system of claim 15, wherein the position sensitive devices provide output signals to a four channel PID controller, the controller having means for controlling each of the laser beams in response to the output signals.

17. The system of claim 16, wherein additional heating radiation incident upon the sample is monitored, the feedback means providing sufficient modification to the lasers to provide a repulsive force vectorially canceling an effective thrust of the heating radiation.

18. A method for positioning samples in a low gravity environment by using a set of four pulsed lasers, each positioned at a corner of a three-dimensional tetrahedronal space, a pair of position sensitive devices for measuring the position, along three coordinate axes, of a sample floating within the tetrahedronal space, and a feedback control system having a four channel PID controller for receiving sample position signals from the pair of position sensitive devices and for controlling one or more of the intensity, duration or pulse cycle rate of one or more of the lasers, the method comprising the steps of:

determining the position of the sample within the tetrahedronal space using the pair of position sensitive devices;

adjusting one or more of the intensity, duration or beam cycle rate of one or more of the lasers, in response to the detected position of the sample, using the feedback control system;

activating the one or more lasers to generate one or more laser beams in accordance with the adjusted intensity, duration or beam cycle rate; and illuminating the sample with the pulsed laser beams to reposition the sample within the tetrahedonal space, the laser beams providing repulsion forces upon the sample.

19. The method of claim 18, wherein the feedback system operates to adjust the lasers to provide repulsive forces to oppose any motion of the sample, whereby the sample remains confined within a confinement zone defined to include a region where the laser beams overlap and to include a region along each respective laser beam between a source of the respective laser beam and the region of beam overlap.

* * * * *